US005312185A

United States Patent [19]

Kojima et al.

[11] Patent Number: 5,312,185

[45] Date of Patent: May 17, 1994

[54] MOTIONLESS MIXER AND METHOD FOR MANUFACTURING THE SAME

[76] Inventors: Hisao Kojima, 3-53-21, Shioiri-cho, Tsurumi-ku, Yokohama-shi, Kanagawa-ken; Akio Tsubota, 128, Yamabuki-cho, Shinjuku-ku, Tokyo, both of Japan

[21] Appl. No.: 634,387

[22] Filed: Dec. 27, 1990

[30] Foreign Application Priority Data

Dec. 28, 1989 [JP] Japan ..... 1-341645

[51] Int. Cl.[5] ..... B01F 5/06; F15D 1/02

[52] U.S. Cl. ..... 366/339; 366/340; 138/37

[58] Field of Search ..... 366/337, 338, 339, 336, 366/340, 341, 176, 183; 48/189.4; 138/37, 38, 39, 42; 165/109.1; 222/135, 137, 459

[56] References Cited

U.S. PATENT DOCUMENTS

| | | | |
|---|---|---|---|
| 1,741,019 | 12/1929 | Harrington | 336/338 |
| 2,864,405 | 12/1958 | Young | 138/38 |
| 4,222,672 | 9/1980 | Shaw | 366/338 |
| 4,767,026 | 8/1988 | Keller | 366/339 |
| 4,850,705 | 7/1989 | Horner | 366/339 |
| 4,902,418 | 2/1990 | Ziegler | 366/339 |

*Primary Examiner*—Harvey C. Hornsby

*Assistant Examiner*—Randall E. Chin

*Attorney, Agent, or Firm*—Jones, Tullar & Cooper

[57] ABSTRACT

Holes are formed in boundary portions of a blade member between first blade sections which are spirally twisted in a clockwise direction, between second blade sections which are spirally twisted in a counterclockwise direction and/or between the first and second blade sections thereof. Thus, the blade sections are joined to each other at portions lying on both sides of the hole. That is, the first and second blade sections are joined at two points or on both side portions and therefore the mechanical strength of the blade member is high.

When the fluid passes from the first blade section into the second blade section or passes the boundary portion between the first or second blade sections, it passes the hole formed in the central portion. When the fluid flows along the spiral fluid path, it flows with a turning movement and moves between the center and the side wall of the tubular member. The fluid near the side wall of the tubular member is interrupted by the boundary portion formed in contact with the internal surface of the tubular member and it receives a shearing force. Then, the fluid is divided and passes the hole at the center. Thus, the high efficiency of mixing can be obtained.

4 Claims, 4 Drawing Sheets

MOTIONLESS MIXER AND METHOD FOR MANUFACTURING THE SAME

BACKGROUND OF THE INVENTION

This invention relates to a motionless mixer for mixing two or more kinds of fluids (such as liquids or powders) without using a mechanically moving member, and a method for manufacturing the same.

For example, this type of motionless mixer is used to mix main material of epoxy resin used for packaging electronic parts with a curing agent. The motionless mixer is used in the chemical industry, paper and pulp industry, food industry, fermentation industry, plastic industry, and allied industries of pollution prevention in addition to the semiconductor industry.

The motionless mixer is constructed by disposing a plurality of blades which are coupled to each other and arranged in a spiral form in a pipe. While two or more kinds of fluids having different properties pass in the motionless mixer, the fluids flow along a path defined in a spiral form by the blades and are separated at each boundary of the blades and meet along another path (see, for example, U.S. Pat. No. 4,408,893). The fluids are stirred and mixed after being repeatedly divided and engaged as described above.

The fluids include liquids, gases, powdered particles and the like. The different properties of the fluids are viscosity, composition, temperature, particle size, or the like. The fluid mixer can also be used to mix fluids of different phases with each other, such as a liquid and a gas.

The above fluid mixer is used as a means of mixing, stirring, dispersion, emulsification, extraction, heat exchange, reaction, gas absorption and dilution in each of the above described industries.

As a means of manufacturing the fluid mixer, it is known to insert blades spirally twisted in a clockwise or counterclockwise direction into a pipe and join the adjacent blades by means of welding or soldering (see Japanese Patent Publication No. 44-8290). There is also provided a technique of inserting blades spirally twisted in a clockwise or counterclockwise direction into a pipe, engaging the adjacent blades with each other and arranging the blades in the pipe (see German Patent Disclosure No. 2262016). Further, it is also known to insert blades spirally twisted in a clockwise or counterclockwise direction into a pipe with a supporting member disposed between the adjacent blades and fix and couple the blades together by means of the supporting members (U.S. Pat. No. 3,953,002). Further, it is known to insert baffle plates spirally twisted in a clockwise or counterclockwise direction into a tubular housing and engage U-shaped grooves formed in the projecting end portions of the baffle plates with each other to couple the baffle plates together (see Japanese Patent Publication No. 1-31928).

However, the above means of manufacturing have defects that make it difficult to effect the manufacturing process.

Particularly when the blades are welded or soldered to each other, the mechanical strength of the welded or soldered portion becomes weak, and the welded portion may be damaged or broken when torsion stress is applied thereto.

Further, as described above, the manufacturing process is not easy in the conventional fluid mixer and therefore the manufacturing cost is high and the mixing effect will be low.

OBJECTS AND SUMMARY OF THE INVENTION

An object of this invention is to provide a fluid mixer in which the mechanical strength of the coupling portion between blades is high and the fluid mixing effect is high and which is low in manufacturing cost, and also to provide a manufacturing device capable of manufacturing the fluid mixer at high efficiency.

A motionless mixer according to the present invention which mixes a plurality of fluids, may comprise:

a tubular member for permitting the fluids to pass; and a blade member disposed in the tubular member to divide a space inside the tubular member into a plurality of fluid paths, the blade member being constructed by alternately arranging first blade sections which are spirally twisted in a clockwise direction and second blade sections which are spirally twisted in a counterclockwise direction in a lengthwise direction of the tubular member and having holes formed in boundary portions between the first and second blade sections.

A motionless mixer according to the present invention, for mixing a plurality of fluids may also comprise:

a tubular member for permitting the fluids to pass; and member disposed in the tubular member to divide a space inside the tubular member into a plurality of fluid paths, the blade member having first blade sections spirally twisted in a clockwise direction and second blade sections spirally twisted in a counterclockwise direction arranged in a lengthwise direction of the tubular member, the end portions of adjacent sections at the boundary between the first blade sections, second blade sections and/or the first and second blade sections being twisted to cross each other at right angles and the boundary portion having a hole.

A fluid mixer manufacturing device according to the present invention, which manufactures a fluid mixer having blade sections spirally twisted at a preset angle and serially connected with the boundary portions thereof crossing each other, comprising:

feeding means for intermittently feeding a belt-like member having cut-away portions or holes in portions which will be boundary portions of the fluid mixer in a lengthwise direction thereof;

a pair of holding members for holding the belt-like member at both end portions of the blade section;

holding member driving means for driving the holding members between a holding position in which the belt-like member is held and a separated position which is separated from the belt-like member; and twisting/rotating means for rotating one of the holding members around the belt-like member to spirally twist the belt-like member.

In this invention, holes are formed in boundary portions between first blade sections which are spirally twisted in a clockwise direction, between second blade sections which are spirally twisted in a counterclockwise direction and/or between the first and second blade sections. In the conventional fluid mixer, the spiral blades are joined to each other at the central portion thereof in a spot form. That is, the spiral blades are joined at one point in a spot form. In contrast, in the fluid mixer of this invention, a hole is formed in the coupling portion (boundary portion) of the blades (first and second blade sections) and the blades are joined to each other at portions lying on both sides of the hole. That is, the first and second blade sections spirally formed to constitute the blade member are joined at two points or on both side portions and therefore the mechanical strength is high.

When the fluid passes from the first blade section into the second blade section or passes the boundary portion between the first or second blade sections, it passes the hole formed in the central portion. When the fluid flows along the spiral fluid path, it flows with a turning movement and moves between the center and the side wall of the tubular member. However, when the fluid passes from the first blade section to the second blade section or flows in a reverse direction, the fluid which has been forced towards the side wall of the tubular member is interrupted by the boundary portion formed in contact with the internal surface of the tubular member and it receives a shearing force. Then, the fluid is divided and passes the hole at the center. For this reason, the efficiency of mixing fluids which have flowed along a plurality of fluid paths becomes high.

In the fluid mixer manufacturing device according to this invention, when the feeding means feeds a belt-like member by one pitch, the holding member driving means drives a pair of the holding members so that both end portions of the blade section of the belt-like member can be held by the holding members. Next, twisting-/rotating means rotates one of the holding members around the belt-like member so as to spirally twist the belt-like member. After this, the holding member driving means separate the holding member from the belt-like member to interrupt the holding action thereof. Then, the feeding means feeds the belt-like member by one pitch to set a next blade section between the holding members and the same process is repeatedly effected to form a combination of blades from the belt-like member. In this case, a combination of clockwise and counterclockwise rotation type blades which are alternately coupled can be obtained by alternately changing the twisting direction in the twisting operation effected by the twisting/rotating means. The edge portions of the respective blade sections can be set to cross each other by rotating the blade sections by 90° or 180°, for example, with respect to each other at the boundary portion between the blade sections by use of crossing/rotating means.

A fluid mixer can be formed by inserting the combination of blade sections thus formed into a pipe. According to a device of this invention, the combination of blade sections can be continuously formed in a sequence of steps by twisting the belt-like member and/or crossing/rotating the same at the boundary portion between the unit portions thereof so that the manufacturing process can be made extremely easy. Further, each of the steps can be easily automated by use of a control device, thereby making the manufacturing process easier.

DETAILED DESCRIPTION OF THE PREFERRED EMBODIMENTS

Figure 1:
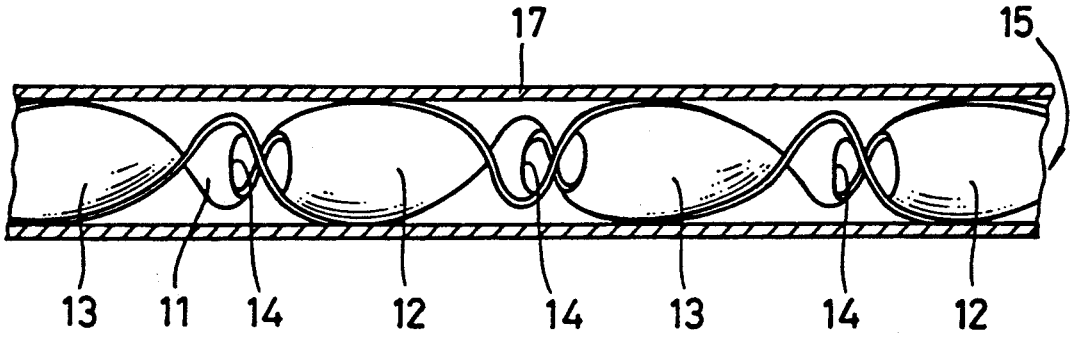
FIG. 1 is a front cross sectional view showing a fluid mixer according to one embodiment of this invention.

As shown in FIG. 1, different kinds of fluids, for example, two kinds of fluids are permitted to pass in a tubular member 17 in a lengthwise direction thereof. A blade member 15 is disposed inside the tubular member 17. The blade member 15 includes first blade sections 12 which are spirally twisted by 180° in a clockwise direction and second blade sections 13 which are spirally twisted by 180° in a counterclockwise direction. The first and second blade sections are alternately disposed in a lengthwise direction of the tubular member 17. A hole 14 is formed in each boundary portion 11 between the first and second blade sections 12 and 13. A portion in which the hole 14 is formed is twisted so that the end portions of the first and second blade sections 12 and 13 will cross each other at an angle of approx. 90°. The blade member 15 is inserted into the tubular member 17 and is fixed on the tubular member 17 at a certain portion. As a result, a space in the tubular member 17 is divided into two fluid paths by the first and second blade sections 12 and 13 of the blade member 15.

With the fluid mixer of the above construction, two different kinds of fluids which have passed through the first blade section 12 arranged at the fluid inlet portion of the blade member 15 flows into the hole 14 at the boundary portion between the first and second blade sections 12 and 13. Then, the fluid which flowed through one of the fluid paths is divided at the boundary portion and meets the fluid which flowed through the other fluid path. The two different kinds of fluids are mixed after being repeatedly divided and meeting as described above.

In this embodiment, when the fluid passes from the first blade section 12 to the second blade section 13 or flows in a reverse direction, the fluid which flowed along the inner surface side of the wall is interrupted by the edge portion of the hole 14 and receives a shearing force. Then, the fluid is divided and passes through the hole 14 and flows further. Therefore, even if the fluid flows along the spiral fluid path with a turning movement and is forced towards the inner surface side of the tubular member 17, the fluid passes through the hole 14 at the center each time it passes the boundary between the first and second blade sections 12 and 13, and thus the fluid tends to flow in the central portion of the tubular member 17, permitting the fluids to be uniformly mixed. Therefore, the mixing efficiency becomes high.

The boundary portion lying between the first and second blade sections 12 and 13 and twisted by approx. 90°, is connected at two portions on both sides of the hole 14. Therefore, the mechanical strength of the twisted portion (boundary portion) is high.

Figure 2:
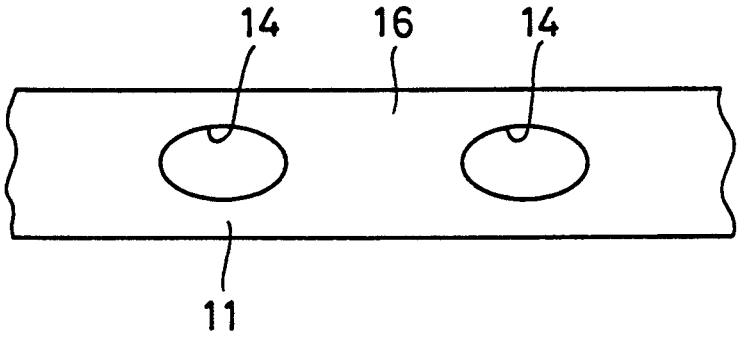
FIG. 2 is a plan view showing a material used for manufacturing a blade member.

Further, unlike the conventional case, a plurality of blades are not joined at the edge portion thereof and the blade member 15 can be formed by spirally twisting a portion between the holes 14 of a material 16 shown in FIG. 2 and twisting a portion including the hole 14 by approx. 90° so that the manufacturing cost thereof can be made low.

Figure 3:
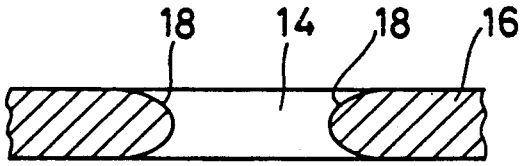
FIG. 3 is a sectional view showing the edge portion of the hole of FIG. 2.

In the member 16, as shown in FIG. 3, the edge portion 18 of the hole 14 can be made sharp by crushing the edge portion 18 of the hole 14 by use of a punch, for example, so as to reduce the resistance against the fluid flow as seen in FIG. 3, the sharp edge portion 18 has a generally parabolic shape. Since the blades joined by welding or the like in the conventional fluid mixer, the edge portion of the blade cannot be made sharp. However, in this embodiment, since an operation of joining the blade sections to each other is not necessary, the edge portion of a portion for dividing the fluid can be made sharp so as to reduce the resistance of the fluid flow resistance.

In the above embodiment, the shape of the hole 14 is formed in an ellipse form but it is not limited to this and can be formed in a different form such as a round or triangular form.

Further, the pitch of the holes 14, that is, the pitch of boundaries between the first and second blade sections 12 and 13 is not necessarily set to a constant value as in the above embodiment, but a combination of a plurality of pitches varying at a regular interval, for example, a combination of pitches of 1, $\frac{1}{2}$, $\frac{1}{3}$, 1, $\frac{1}{2}$, $\frac{1}{3}$, for example, can be set. Also, it is not necessary to set the diameter of the hole 14 to a constant value.

Next, a manufacturing device suitable for manufacturing the above-described fluid mixer is explained.

Figure 4:
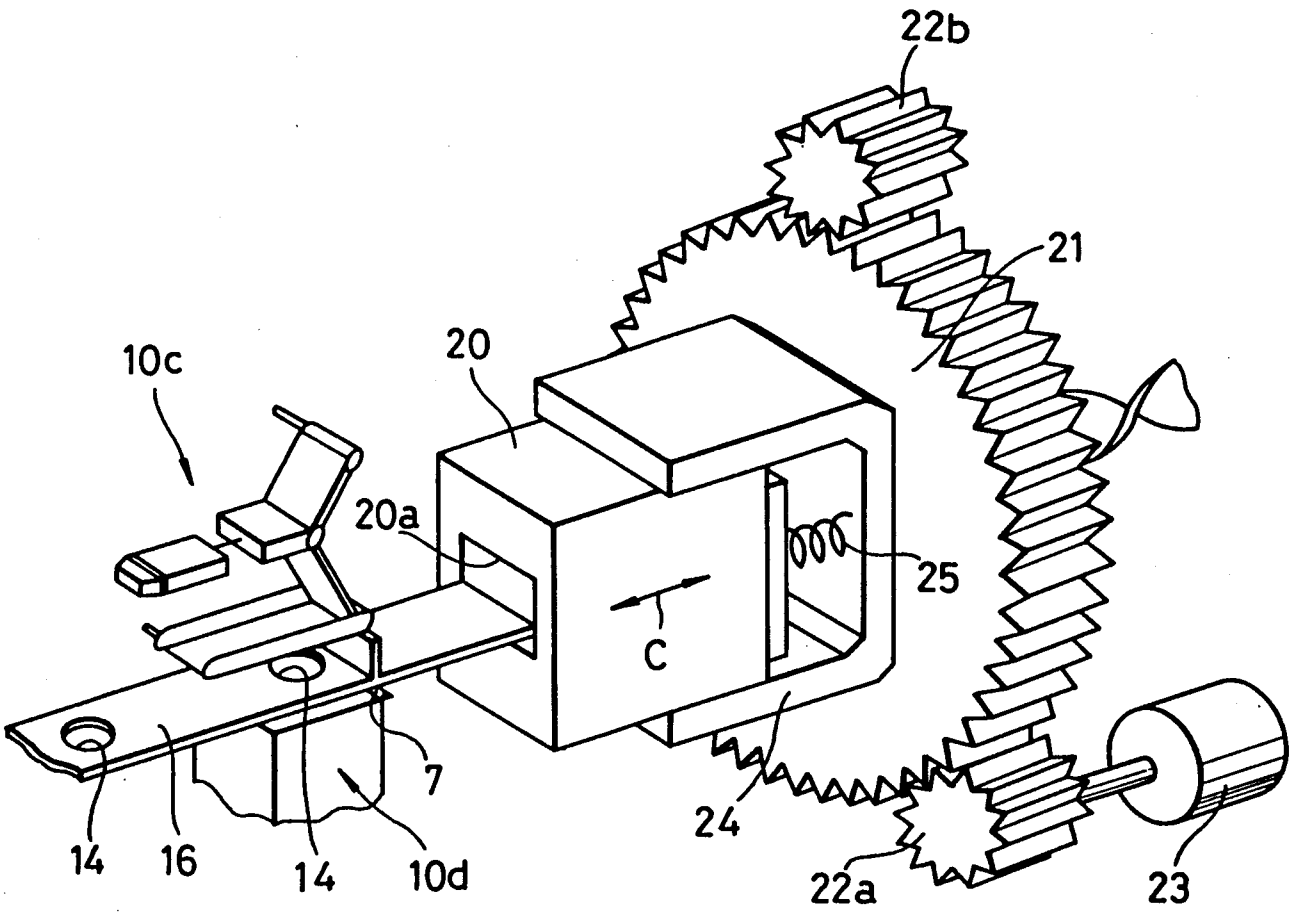
FIG. 4 is a perspective view showing a fluid mixer manufacturing device according to an embodiment of this invention.
Figure 5:
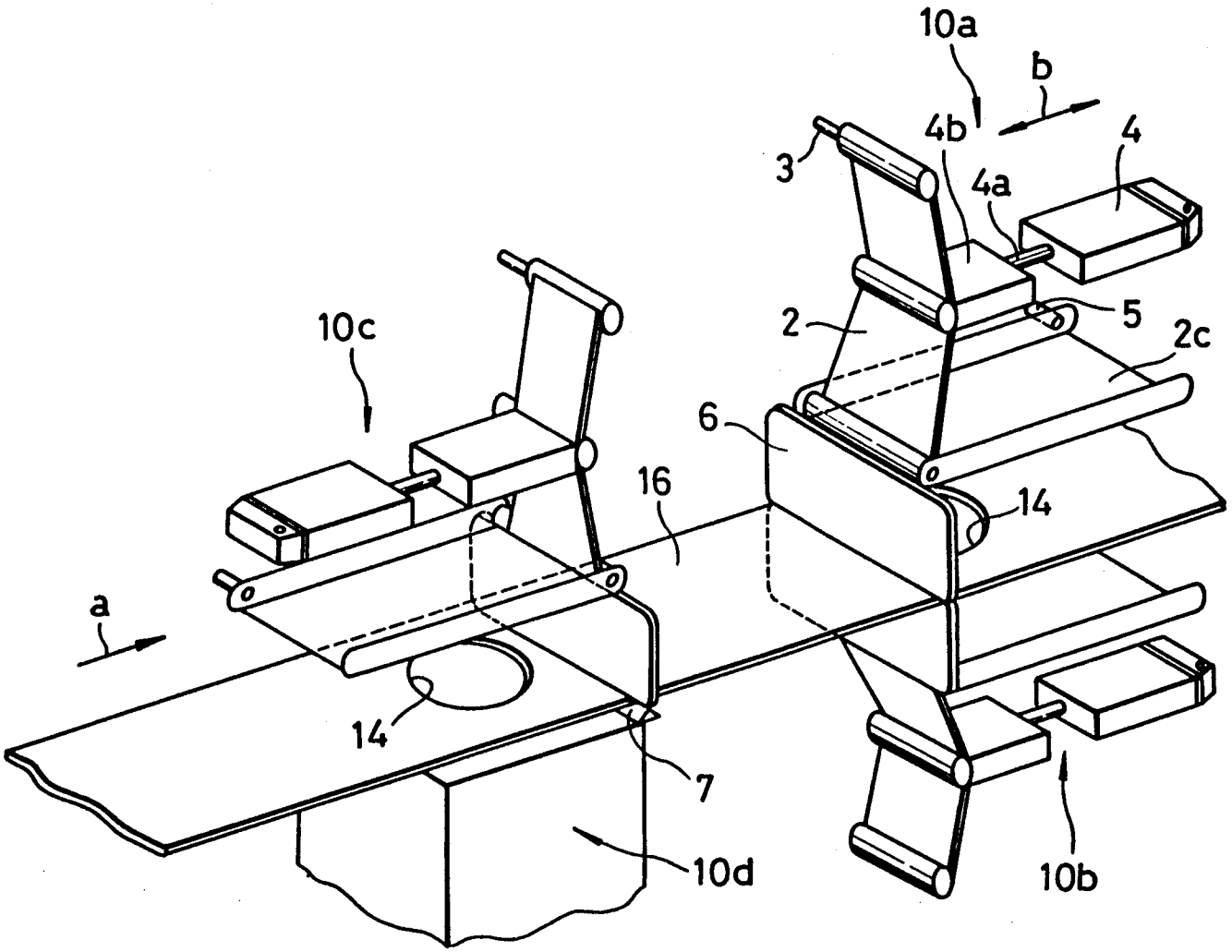
FIG. 5 is a perspective view showing the whole portion thereof.

FIG. 4 is a perspective view of a manufacturing device according to one embodiment of this invention and FIG. 5 is a schematic diagram of the entire portion thereof.

A belt-like member 16 is intermittently driven in a direction indicated by an arrow a (FIG. 5) by use of a proper driving means (not shown). Holding devices 10*a* and 10*b* and holding devices 10*c* and 10*d* are arranged in the range of movement of the belt-like member 16 with a separation distance set slightly shorter than one pitch of the intermittent movement of the belt-like member 16 in the moving direction of the belt-like member 16. The holding members 10*a* and 10*b* are symmetrically arranged above and below the belt-like member 16, respectively. Since the upper device 10*a* and lower device 10*b* have the same construction and are different only in that one of them is set upside down, an explanation is made mainly for the upper device 10*a*. A lever 2 having a large width and a dog-legged shape as viewed from the side is rotatably supported at the upper end thereof on a shaft 3. The shaft 3 is fixed with the lengthwise portion thereof set in a horizontal plane. A solenoid 4 is fixed on a proper holding device with a rod 4*a* thereof set in the horizontal plane. The solenoid 4 moves the rod back and forth along a direction b. A plate-like coupling member 4*b* is fixed on the front end of the rod 4*a* and the front end of the coupling member 4*b* is fixed on the central bent portion of the lever 2. Therefore, when the rod 4*a* is moved forwardly in the direction b by the operation of the solenoid 4, the lever 2 rotates downwardly around the rotation shaft 3, and when the rod 4*a* is retracted or moved back into the solenoid 4, the lever 2 rotates upwardly around the rotation shaft 3.

The front end portion of a plate-like guide member 2*c* is rotatably mounted on the lower end portion of the lever 2 and a guide rod 5 is fixed on the rear end of the guide member 2*c* so as to project from the guide member 2*c* in a horizontal direction. The guide rod 5 is inserted into a guide groove (not shown) fixedly formed to control the locus of the rear end of the guide member when the guide member 2*c* is moved by means of the solenoid 4.

A holding member 6 is fixed on the front end of the guide member 2*c* with the surface thereof set substantially in a vertical plane.

As described before, the holding device 10*b* is arranged below the belt-like member 16 and is constructed to be plane-symmetrical with the holding device 10*a* with the belt-like member 16 set as the center of the symmetry, and the construction of each portion thereof is the same as the holding device 10*a*.

The holding device 10*c* which is disposed behind the holding device 10*a* with respect to the traveling direction of the belt-like member 16 is disposed above the belt-like member 16 and constructed to be plane-symmetrical with the holding member 10*a* with respect to a vertical plane. Since the construction and the coupling relation of respective portions of the holding device 10*c* are the same as those of the holding device 10*a*, the detail explanation therefore is omitted.

The holding member 10*d* which is disposed below the belt-like member 16 in opposition to the holding device 10*c* is fixed on the floor and has a rod-like engaging portion 7 which is projected to hold the belt-like member 16 between it and the holding member 6 of the holding device 10*c*.

The holding devices 10*a* and 10*b* which are disposed in front of the holding devices 10*c* and 10*d* with respect to the traveling direction of the belt-like member 16 are set into a cubic case 20 as shown in FIG. 4. Therefore, the guide rods 5 of the holding devices 10*a* and 10*b* are engaged with grooves formed in the side wall of the case 20. Only the guide rod of the holding device 10*c* shown in FIG. 5 is engaged with the guide groove formed in a member which is fixed near the device.

A window 20*a* is formed in the rear surface of the case 20 with respect to the traveling direction of the belt-like member 16 and the holding members 6 of the holding devices 10*a* and 10*b* are exposed to the exterior through the window 20*a*.

The case 20 is supported by a housing 24 having a laterally inverted form of rectangular "C"-shape as viewed from the side and the housing 24 is fixed on the front portion of a gear 21. The gear 21 is rotatably mounted with the path of the belt-like member 16 set as a center and a hole which permits the belt-like member 16 to pass is formed in the central portion thereof. Three small gears 22*a*, 22*b* (only two gears are shown here) which engage with the teeth of the gear 21 are rotatably mounted on the peripheral portion of the gear 21 with the central axis thereof fixed, and the gear 21 is supported by the three gears 22*a*, 22*b* so as to rotate around the path of the belt-like member 16 to a preset position. Among the small gears, the small gear 22*a* is connected to the rotation shaft of a motor 23 and the gear 21 is rotated by rotating the gear 22*a* by means of the motor 23.

A hole for permitting the belt-like member 16 to pass is formed in that wall surface of the housing 24 which is fixed on the gear 21. Grooves (not shown) which extend in a traveling direction of the belt-like member 16 are formed in the opposite faces of a pair of plate-like projecting portions of the housing 24 for holding the case 21 and projecting portions (not shown) which engage with the grooves of the housing 24 are formed on the upper and lower surfaces of the case 20. For this reason, the case 20 can be slightly moved in a traveling direction of the belt-like member 16 as shown by an arrow c with the projecting portions thereof engaged with the inner surface grooves of the housing 24. However, a proper stopper (not shown) is formed in the groove so that the case 20 will not be separated from the housing 24.

A compression spring 25 is provided between the side surface of the housing 24 and the side surface of the case 20 so as to resiliently bias the case 20 in a direction opposite to the traveling direction of the belt-like member 16.

Next, the operation of the fluid mixer manufacturing device of the above construction is explained. As shown in FIG. 2, the belt-like member 16 to be formed in a predetermined shape of a fluid mixer has the same width as the blade section of the fluid mixer. Holes 14 are formed at a regular interval in the central areas of portions corresponding to boundary portions between the blade sections 12 and 13 constituting the unit sections of the fluid mixer. The pitch and width of the holes 14 are selected according to the shape of the blade member of the fluid mixer to be manufactured. Normally, the width of the blade section between the holes 14 and the width of the hole 14 are respectively set to constant values, but they are not necessarily set to the constant values.

First, the interval between the holding members 6 of holding devices 10*a*, 10*b* and the holding member and engaging portion of the holding devices 10*c*, 10*d* is set to be slightly smaller than the interval between the cut-away portions 14 of the belt-like member 16 to be used. Then, the belt-like member 16 is inserted between the holding members 10*a* and 10*b* and between the holding members 10*c* and 10*d*, and the belt-like member 16 is stopped without setting the hole 14 between the holding members 6 of the holding devices 10*a* and 10*c* and with the hole 14 set outside the holding member 6. Next, The solenoids 4 of the holding devices 10*a*, 10*b* and 10*c* are turned on to move the pistons thereof in a forward direction. As a result, the lever 2 rotates to come closer to the belt-like member 16 and the belt-like member 16 is held between the holding members 6 of the holding devices 10*a* and 10*b* and between the holding member 6 of the holding device 10*c* and the engaging portion 7 of the holding device 10*d*.

Next, the small gear 22*a* is rotated in response to rotation of the motor 23 so as to rotate the gear 21 by an angle of 180°, for example. Then, the holding member 6 and the engaging portion 7 of the holding devices 10*c* and 10*d* hold the belt-like member 16 as it is, and at this time, the holding devices 10*a* and 10*b* are inserted into the case 20 and rotated together around the belt-like member 16. As a result, a portion which is held by the holding devices 10*a* and 10*b* is rotated by an angle of 180°, for example, to twist a portion of the belt-like member 16 which lies between the holding devices 10*a* and 10*c* into a spiral form.

After this, each solenoid 4 is turned off and the piston 4*a* thereof is retracted, the lever 2 is separated from the belt-like member 16 and the holding member 6 and engaging portion 7 stop the operation of holding the belt-like member 16.

Then, the driving means for driving the belt-like member 16 feeds the belt-like member 16 in a direction a by the pitch of the array of the hole 14 of the belt-like member 16. As a result, a portion which is not yet worked and lies adjacent to the portion which has been twisted in the preceding step is set between the holding devices 10*a* and 10*c*. After this, the solenoid 4 is turned on so that the belt-like member 16 may be held between the holding member 6 and the engaging portion 7. Next, the motor 23 is rotated in a direction opposite to that set in the preceding step so as to rotate the gear 21 in a reverse direction by 120°, for example. As a result, the belt-like member 16 is twisted by 120°, for example, in a direction opposite to that of the adjacent worked portion so as to form a spiral blade.

A serially connected blade body constituted by spiral blades which are connected in series and whose twisting directions are alternately changed can be formed. The serially connected blade body passes the case 20, housing 24 and gear 21 and is then discharged in the traveling direction of the belt-like member 16.

After this, a serially connected blade body having the blade sections 12 twisted in the clockwise direction and the blade sections 13 twisted in the counterclockwise direction which are connected by means of a boundary portion (the portion where the hole 14 is formed) can be formed by twisting the blade sections by 90° with respect to one another at the boundary portion of the blade section or at a portion having the hole 14 formed therein as shown in FIG. 1. The blade body 15 has blade sections which are twisted by 180° and the connecting portion 11 has blade sections whose edges cross each other at an angle of 90°.

In this way, the blade body 15 can be integrally formed in such a shape as shown in FIG. 1. A fluid mixer in which two fluid paths are defined by the blades can be formed by inserting the blade body 15 into the pipe and fixing them at a certain portion. According to this embodiment, the blade body 15 having blade sections serially connected can be extremely easily formed. Further, a fluid mixer can be constructed simply by inserting the blade body 15 into the pipe and fixing the blade body 15 and the pipe on each other at the end portion of the blade body 15 in the lengthwise direction so that the manufacturing process can be made extremely easy. Further, since the boundary portion for the blade sections 11*a* and 11*b* is part of the belt-like member 16 and is not formed by welding or the like after assembling the blades, the connecting portion is mechanically strong. As a result, even if a stress is applied to the connecting portion, it will not be broken.

Figure 6:
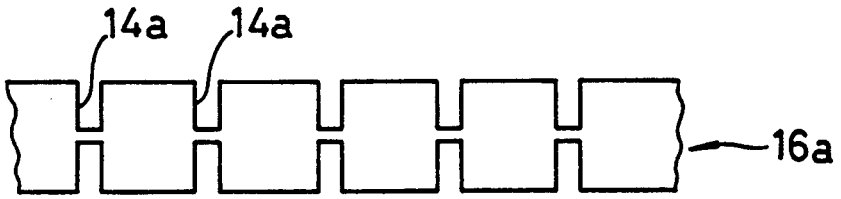
FIG. 6 is a plan view showing a material for a blade member used for manufacturing a modification of a fluid mixer which can be manufactured by the manufacturing device.
Figure 7:
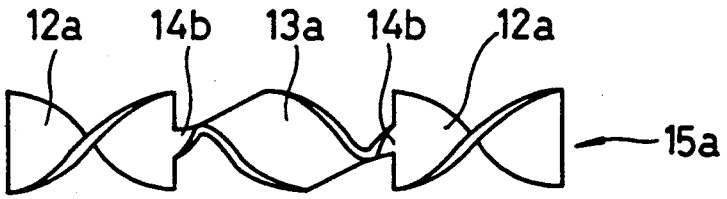
FIG. 7 is a front view showing the blade member.

This invention is not limited to the above embodiment. For example, it is also possible to use a belt-like member 16*a* having cut-away portions 14*a* instead of the holes 14 as shown in FIG. 6 so as to attain the same effect. In this case, in a blade body 15*a* obtained, a boundary portion 14*b* between the blade sections 12*a* and 12*b* is formed at the center as shown in FIG. 7.

The array pitch of the cut-away portions 14*a* formed in the belt-like member 16*a*, and the width of the cut-away portion 14*a* are not necessarily set to constant values.

Further, in the above embodiment, the boundary portion between the blade sections is formed on a line different from the blade forming line, but it is also possible to form the boundary portion or cross portion on a line which is the same as the blade forming line.

In this case, the width of the hole 14 or the cut-away portions 14*a* of a single sheet of belt-like member 16, 16*a* is designed to be changed, the holes 14 or the cut-away portions 14*a* can be detected and the position of the case 20 can be adjusted by means of the driving means based on the result of detection by constructing the case 20 for receiving the holding devices 10*a*, 10*b* to move in the traveling direction of the belt-like member 16, using the driving means for driving the case 20 in this direction and using detection means for detecting the holes 14 or the cut-away portions 14*a*. As a result, even if the array pitch of the holes 14 or the cut-away portions 14*a* is changed, the blade can be easily formed in the same manner.

Further, a pulse motor or the like can be used as the motor 23, and the gear 21 can be rotated by a preset angle by driving the pulse motor by an angle corresponding to a preset number of pulses. It is also possible to use detection means for electrically or mechanically detecting the rotation position of the gear 21 and control the rotation of the gear 21 based on the result of detection of the detection means.

In this invention, the belt-like member is held by use of a pair of holding members and that portion of the belt-like member which lies between the holding members can be twisted by rotating one of the holding members, and therefore a serially connected blade body can be continuously formed in a sequence of steps. As a result, the fluid mixer can be extremely easily manufactured. Further, the process can be easily automated by use of a control device and the manufacturing process can be made easier. Further, since the connected body of the blade (unit section) is formed not by joining different blade sections by use of joining means but is formed by using a single belt-like member, the boundary portion between the unit sections is mechanically strong.

What is claimed is:

1. A motionless mixer for mixing a plurality of fluids, comprising:

a tubular member defining an inside space through which the fluid flow; and a blade member disposed in said tubular member to divide the inside space of said tubular member into a plurality of fluid paths, said blade member having alternately arranged in a lengthwise direction of said tubular member a plurality of first blade sections which are spirally twisted in a clockwise direction, a plurality of second blade sections which are spirally twisted in a counterclockwise direction and a boundary portion between each first and second blade section, and a hole formed in the center of each of said boundary portions between each of said first and second blade sections.

2. A motionless mixer according to claim 1, wherein the edge portion of said hole is defined in a generally parabolic shape.

3. A motionless mixer for mixing a plurality of fluids, comprising:

a tubular member defining an inside space through which the fluids flow; and a blade member disposed in said tubular member to divide the inside space of said tubular member into a plurality of fluid paths, said blade member having alternately arranged in a lengthwise direction of said tubular member a plurality of first blade sections spirally twisted in a clockwise direction, a plurality of second blade sections spirally twisted in a counterclockwise direction and a boundary portion between each first and second blade section defining adjacent sections, and a hole formed in the center of each of said boundary portions between each of said first and second blade sections, wherein end portions of adjacent sections of the boundary portion between at least one of said first blade sections and said second blade sections being twisted to substantially cross each other.

4. A motionless mixer according to claim 3, wherein the edge portion of said hole is defined in a generally parabolic shape.

* * * * *